US007134485B2

(12) United States Patent
Hul-Chun

(10) Patent No.: US 7,134,485 B2
(45) Date of Patent: Nov. 14, 2006

(54) WICK STRUCTURE OF HEAT PIPE

(76) Inventor: Hsu Hul-Chun, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/892,222

(22) Filed: Jul. 16, 2004

(65) Prior Publication Data

US 2006/0011327 A1 Jan. 19, 2006

(51) Int. Cl.
*F28D 15/00* (2006.01)
*H05K 7/20* (2006.01)

(52) U.S. Cl. ..... 165/104.26; 165/104.21; 361/700

(58) Field of Classification Search ..... 165/104.21, 165/104.26, 80.3, 185, 133; 361/700, 705; 257/714, 715; 174/15.2; 29/890.032
See application file for complete search history.

(56) References Cited

U.S. PATENT DOCUMENTS 3,528,859 A * 9/1970 Dey et al. ..... 429/42
3,734,173 A * 5/1973 Moritz ..... 165/104.26
3,892,273 A * 7/1975 Nelson ..... 165/104.26
4,440,215 A * 4/1984 Grover et al. ..... 165/104.21
4,470,451 A * 9/1984 Alario et al. ..... 165/104.26
4,885,129 A * 12/1989 Leonard et al. ..... 419/2
5,895,868 A * 4/1999 Giammaruti et al. .... 73/863.81
6,564,860 B1 * 5/2003 Kroliczek et al. ..... 165/104.26
6,997,244 B1 * 2/2006 Hul-Chun ..... 165/104.26
2003/0141045 A1 * 7/2003 Oh et al. ..... 165/104.26
2003/0159809 A1 * 8/2003 Valenzuela ..... 165/104.26
2003/0183381 A1 * 10/2003 Garner et al. ..... 165/274

FOREIGN PATENT DOCUMENTS

JP 58110991 A * 7/1983

* cited by examiner

*Primary Examiner*—Tho Duong

(57) ABSTRACT

A composite wick structure of a heat pipe which is applied with a tube circumferential surface contacted to a heat source includes a plurality of grooves and a sintered-powder layer. The circular grooves are formed on the internal sidewall of the tubular member. The sintered-powder layer filled in the grooves is attached to at least a portion of the internal sidewall of the tubular member. By the better capillary force provided by the sintered powder, the liquid-phase working fluid can reflow to the bottom side of the heat pipe quickly to enhance the heat transmission efficiency. Further, the problem caused by usage of an axial rod during the process of applying sintered powder can be resolved.

10 Claims, 4 Drawing Sheets

WICK STRUCTURE OF HEAT PIPE

BACKGROUND OF THE INVENTION

The present invention relates in general to a wick structure of a heat pipe, and more particularly, to a composite wick structure of a heat pipe having a tube circumferential surface in contact with a heat source, and the wick structure including a plurality of grooves and a sintered-powder attachment.

Having the features of high heat transmission capability, high-speed heat conductance, high thermal conductivity, light weight, mobile-elements free, simple structure, the versatile application, and low power for heat transmission, heat pipes have been popularly applied in heat dissipation devices in the industry. The conventional heat pipe includes a wick structure on an internal sidewall of the tubular member. The wick structure typically includes the sintered powder to aid in transmission of working fluid.

The fine and dense structure of the powder-sintered wick structure provides better capillary force for reflow of the liquid-state working fluid. However, during fabrication, an axial rod has to be inserted into the tubular member to serve as a support member of the wick structure during the sintering process, so as to avoid collapse of the powder which has not been sintered yet. Therefore, normally the thickness of the sintered powder wick structure is thicker. Consequently, the capillary thermal resistance is increased to be disadvantageous for the heat transmission. Further, requirement of the axial rod hinders the mass production of the heat pipe and causes fabrication and quality issues of the heat pipe.

Thus, there still is a need in the art to address the aforementioned deficiencies and inadequacies.

BRIEF SUMMARY OF THE INVENTION

The present invention provides a composite wick structure of a heat pipe. The heat pipe is applied by a tube circumferential surface in contact with a heat source. The composite wick structure includes a plurality of grooves and a sintered-powder attachment, such that the transmission capability of the wick structure is maintained, and the heat conduction performance of the heat pipe is improved, while the problems with the caused by the axial rod are resolved.

Accordingly, the heat pipe includes a tubular member and a wick structure having a plurality of grooves and a sintered-powder layer. The circular grooves are formed on the internal sidewall of the tubular member. The sintered-powder layer filled in the grooves is attached to at least a portion of the internal sidewall of the tubular member.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
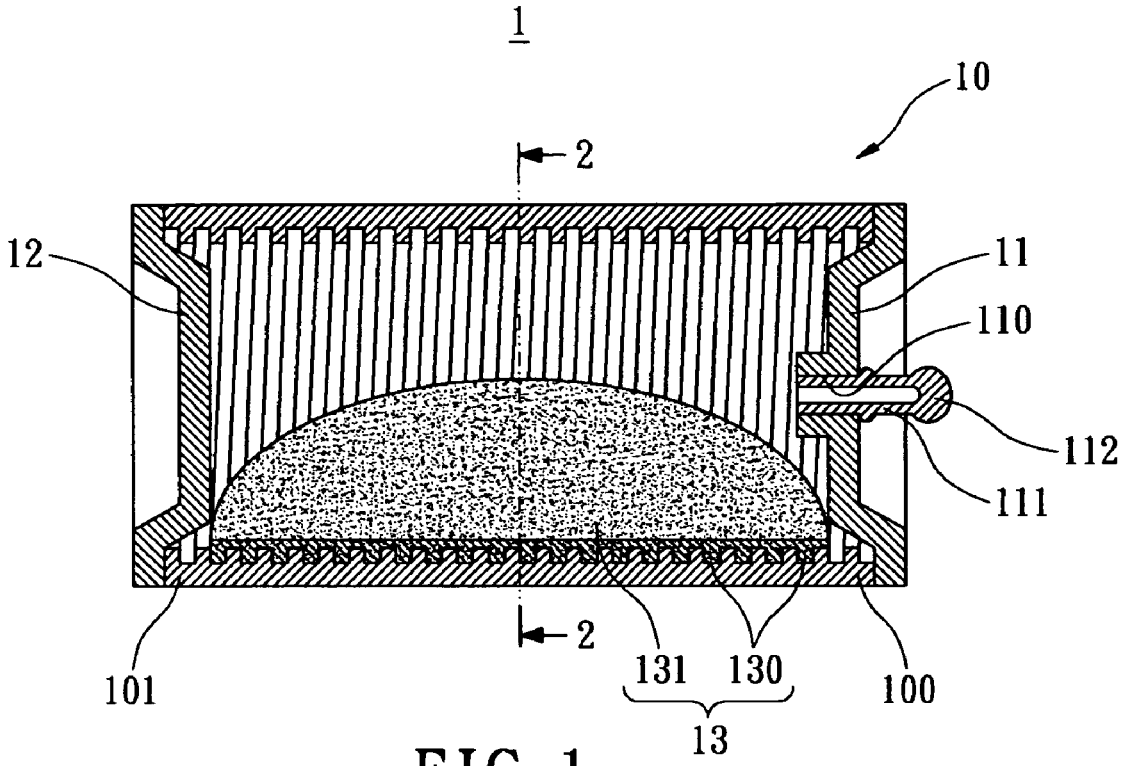
FIG. 1 shows a cross sectional view of a heat pipe according to the present invention.

Referring now to the drawings wherein the showings are for purpose of illustrating preferred embodiments of the present invention only, and not for purposes of limiting the same, FIG. 1 illustrates a cross sectional view of a heat pipe 1 which includes a tubular member 10, a first lid 11 and a bottom lid 12.

The tubular member 10 is preferably in the form of a cylindrical hollow tube having two open ends 100 and 101. The open end 100 is covered with the first lid 11, while the other open end 101 is covered with the bottom lid 12. The first lid 11 and the bottom lip 12 can be made by pressing plates so that the tubular member 10 can be closed and sealed thereby. Moreover, the first lid 11 has a hole 110 extending therethrough allowing a filling pipe 111 to extend into the tubular member 10 for filling an adequate amount of working fluid inside the tubular member 10. By subsequent process such as vacuuming, the tubular member 10 is sealed by tin wetting or spot welding to form a sealed portion 112.

Figure 2:
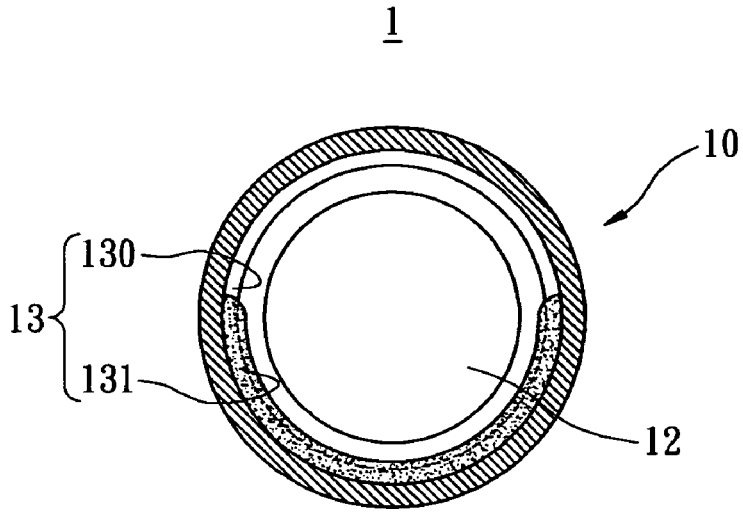
FIG. 2 shows a cross sectional view along line 2—2 of FIG. 1 in one preferred embodiment.
Figure 3:
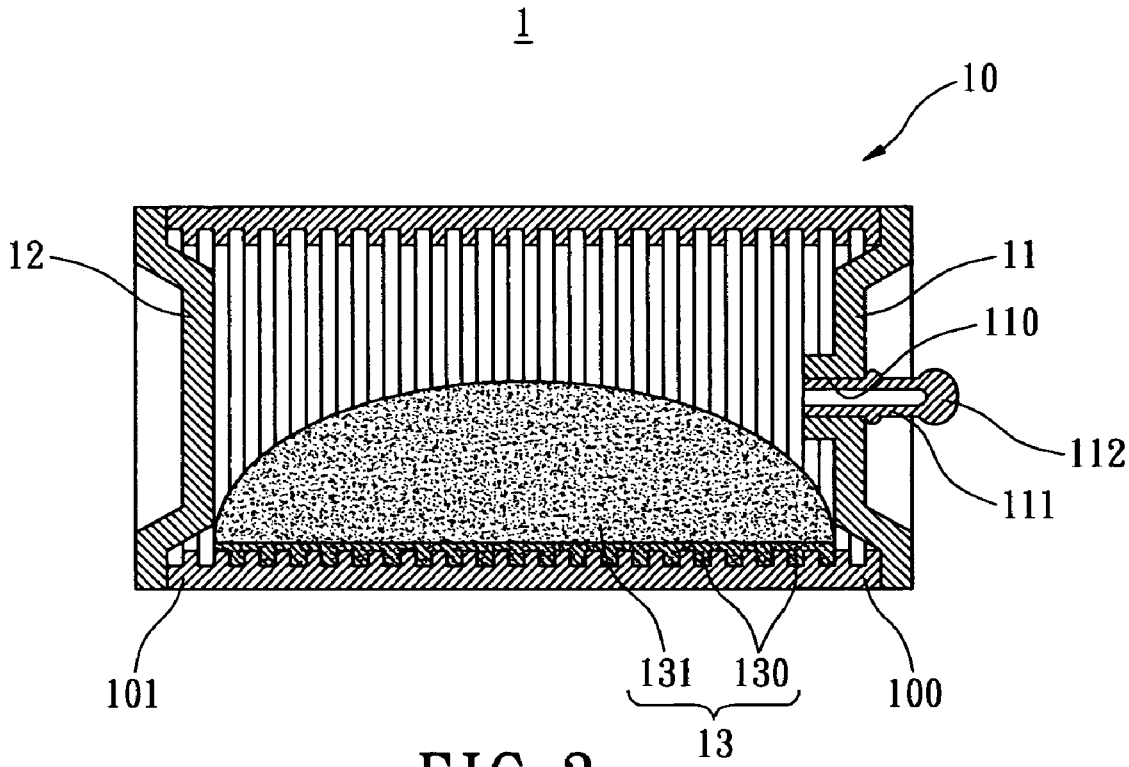
FIG. 3 shows a cross sectional view of a heat pipe according to another preferred embodiment.

Please refer to FIG. 2 together. As shown, a wick structure 13 is attached to the internal sidewall of the tubular member 10. The wick structure 13 includes a plurality of grooves 130 and a sintered-powder layer 131. The grooves 130 can be continued and spirally formed on whole internal sidewall of the tubular member 10, as shown in FIG. 1. In other embodiment, the grooves 130 can be formed as a plurality of rings axially arranged on whole internal sidewall of the tubular member 10. The sintered-powder layer 131 is formed on at least a portion of the grooves 130. Preferably, the sintered-powder layer 131 extends an elongate direction of the tubular member 10 at the center, as shown in FIG. 1, and partially covers around and fills in the grooves 130, as shown in FIG. 2. As the sintered-powder layer 131 does not have to cover the whole grooves 130, the axial rod is not required. To form the sintered-powder layer 131, powder to be sintered is disposed inside of the tubular member 10. The tubular member 10 is laid down with the side at which sintered-powder layer 131 facing downwardly for performing sintering.

Figure 4:
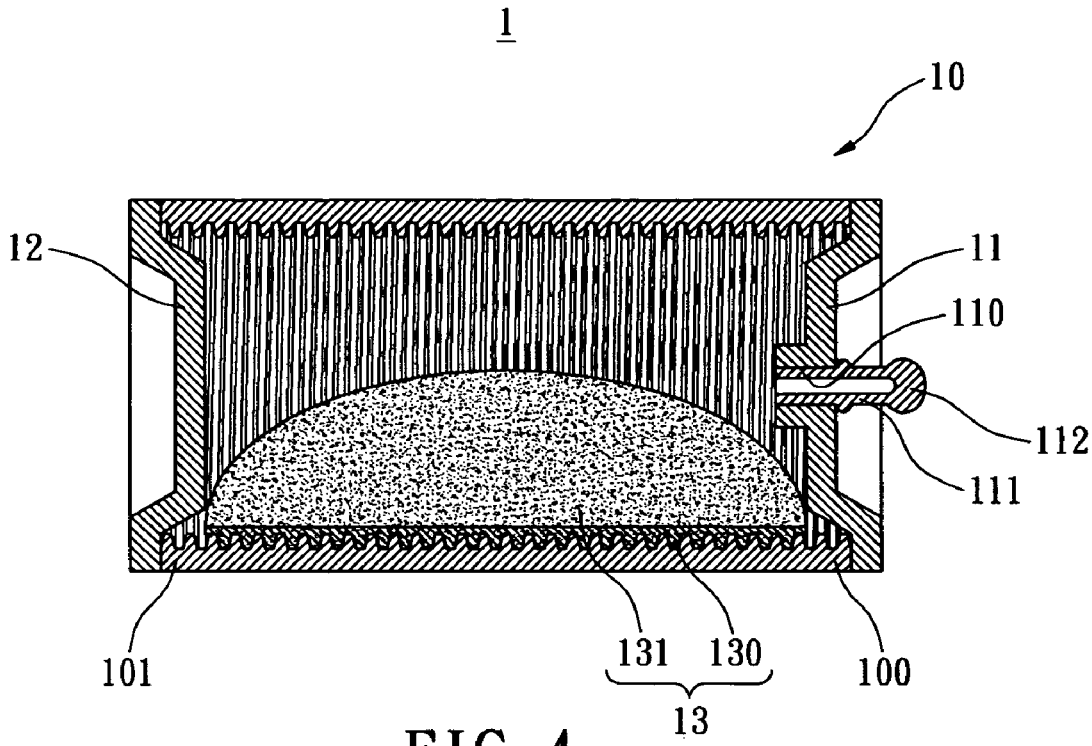
FIG. 4 shows a cross sectional view of a heat pipe according to the other preferred embodiment.

In one preferred embodiment as shown in FIG. 1, each groove 130 has a dented rectangular shape in a cross sectional view along the axial direction of the tubular member 10. However, in other embodiments as shown in FIG. 4 or FIG. 5, the grooves 130 can be tapered to have trapezoidal or triangular shapes, respectively.

Figure 5:
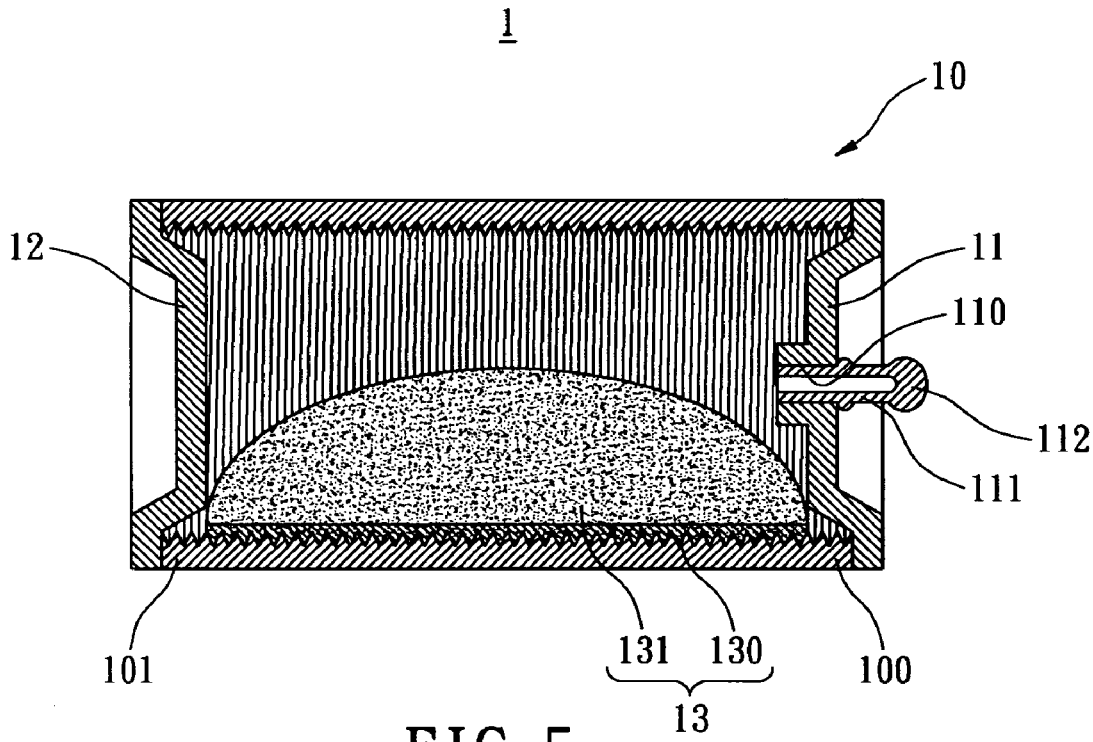
FIG. 5 shows a cross sectional view of a heat pipe according to still the other preferred embodiment.
Figure 6:
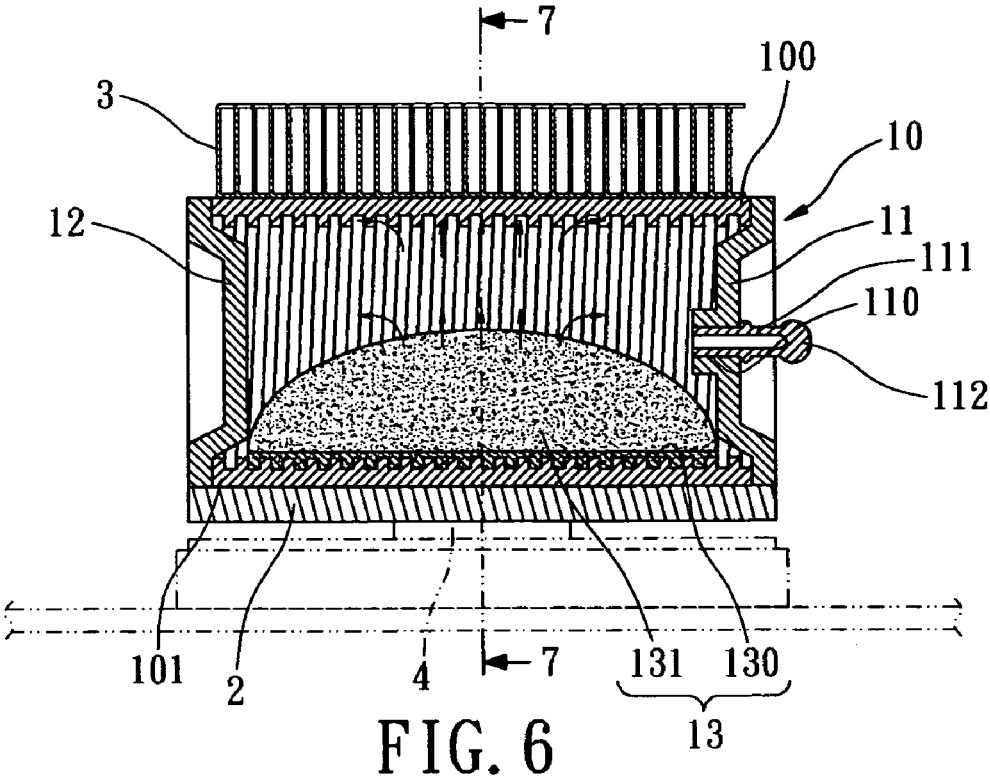
FIG. 6 shows a cross sectional view of a heat pipe in application.
Figure 7:
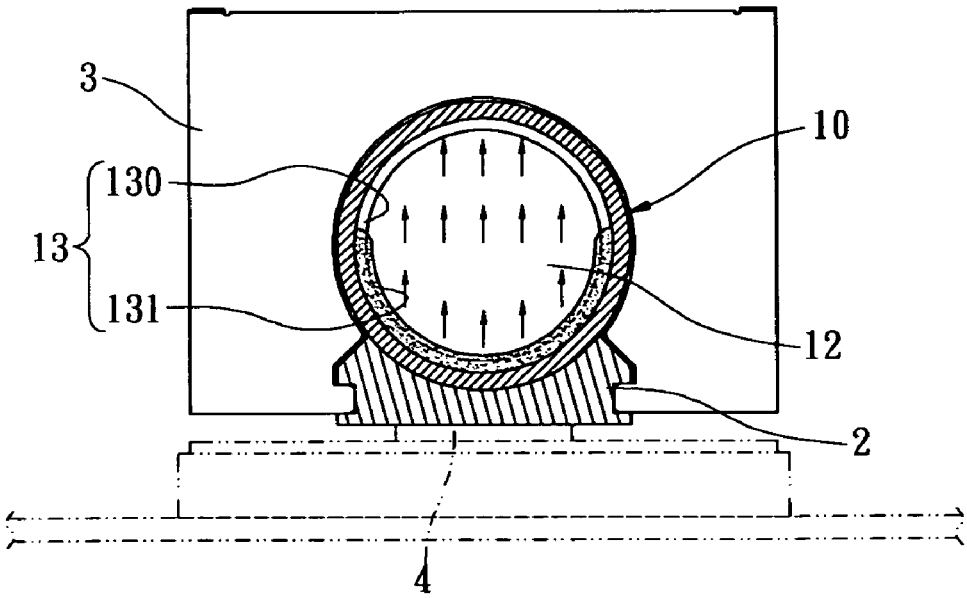
FIG. 7 shows a cross sectional view along line 6—6 of FIG. 6.

FIG. 5 shows a cross sectional of the heat pipe in operation and FIG. 6 shows a cross sectional view along line 6—6 of FIG. 5. As shown, the heat pipe 1 is laid down to be attached on a heat conductive plate 2, and a plurality of heat dissipating fins 3 are mounted on the heat pipe 1. The heat conductive plate 2 is in contact with a heat source 4 where the sintered powder 131 of the wick structure 13 in the heat pipe 1 is located corresponding thereto. When the heat source 4 starts to generate heat, the working fluid in the heat pipe absorbs the heat and is evaporated into gas. The gas then rises up to the upper side of the heat pipe 1 and flows along the circular grooves 130 to be condensed into liquid and reflow to bottom side of the tubular member 10 adjacent to the heat conductive plate 2. Meanwhile, the sintered-powder layer 131 corresponding the heat source 4 has the better capillary effect to instantly absorb the work fluid due to the sintered powder can provide faster liquid flowing. Thereby, the reflow speed of the working fluid is greatly increased to enhance the heat transmission efficiency.

This disclosure provides exemplary embodiments of wick structure of a heat pipe. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A heat pipe comprising:

a tubular member with a circumferential surface attached on a heat conductive plate which has a concave top surface fitly receiving the tubular member that is contacted to a heat source; and a wick structure including a plurality of circular grooves formed on the internal sidewall of the tubular member, wherein a sintered powder layer filled in and attached to at least a portion of the grooves and extended along an elongated direction of the tubular member and on a sidewall portion of the tubular member that corresponds to the circumferential surface attached on the heat conductive plate.

2. The heat pipe of claim 1, wherein the tubular member comprises two opposing ends covered with a first lid and a second lid respectively.

3. The heat pipe of claim 2, wherein the first lid includes a filling tube penetrated therethrough.

4. The heat pipe of claim 3, wherein the filling tube and the first lid are integrally formed.

5. The heat pipe of claim 3, wherein the first lid includes a sealed portion to seal the filling tube.

6. The heat pipe of claim 1, wherein the grooves are continued and spirally formed on the internal sidewall.

7. The heat pipe of claim 1, wherein the grooves formed as a plurality of rings axially arranged on the internal sidewall.

8. The heat pipe of claim 1, wherein each of the grooves has a dented rectangular shape.

9. The heat pipe of claim 1, wherein each of the grooves has a dented trapezoidal shape.

10. The heat pipe of claim 1, wherein each of the grooves has a dented triangular shape.

* * * * *